United States Patent [19]

Whitney et al.

[11] 4,145,772

[45] Mar. 27, 1979

[54] PLASTIC TOILET

[75] Inventors: Thomas M. Whitney, Lapeer; Samuel C. Crosby, Ann Arbor, both of Mich.

[73] Assignee: Trayco, Inc., Lapeer, Mich.

[21] Appl. No.: 814,244

[22] Filed: Jul. 11, 1977

[51] Int. Cl.[2] ..... E03D 1/24; E03D 11/08

[52] U.S. Cl. ..... 4/300; 4/329; 4/353; 4/425

[58] Field of Search ..... 4/1, 10–12, 4/14, 18 R, 18.5, 42, 57 P, 67 R, 67 A, 70, 73, 76–80, 89, 92, 83, 166, 167, 170, 173 R, 85, 300, 315, 324, 329, 333, 345, 353, 378, 393, 416, 417, 420, 421, 422, 424, 425, 434, 438, 440–442

[56] References Cited

U.S. PATENT DOCUMENTS

| | | | |
|---|---|---|---|
| 2,096,306 | 10/1937 | Pieslak | 4/14 |
| 3,131,402 | 5/1964 | Roberts | 4/14 |
| 3,212,106 | 10/1965 | Noel | 4/69 |
| 3,591,868 | 7/1971 | Owens | 4/14 |
| 3,614,793 | 10/1971 | Nemiroff | 4/173 |
| 3,816,234 | 6/1974 | Winfield | 4/173 R X |
| 3,860,973 | 1/1975 | Uyeda et al. | 4/10 X |
| 3,932,901 | 1/1976 | Inui et al. | 4/92 X |
| 3,939,500 | 2/1976 | Miller et al. | 4/85 X |
| 3,988,785 | 11/1976 | Schoepe et al. | 4/57 P |

*Primary Examiner*—Stuart S. Levy

*Attorney, Agent, or Firm*—Cullen, Sloman, Cantor, Grauer, Scott & Rutherford

[57] ABSTRACT

An essentially all-plastic toilet includes a plastic bowl, trap, waterway, tank and rim flush retained within an outer plastic housing. Polyurethane foam fills the space between the outer housing and the internal components to provide a rigid and strong, yet light weight structure.

7 Claims, 10 Drawing Figures

FIG. 7
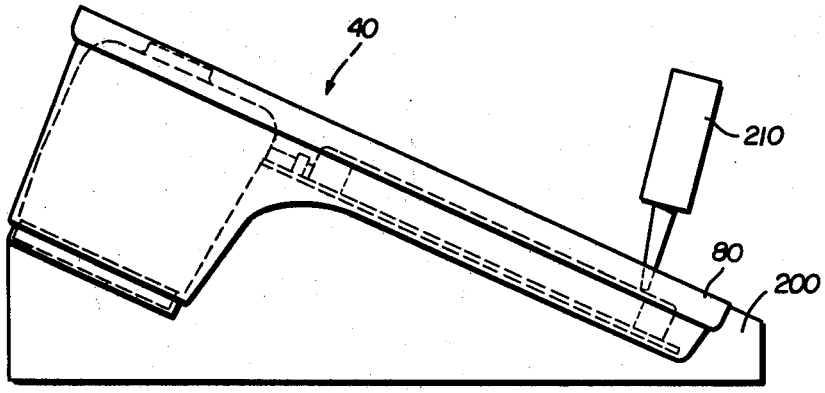
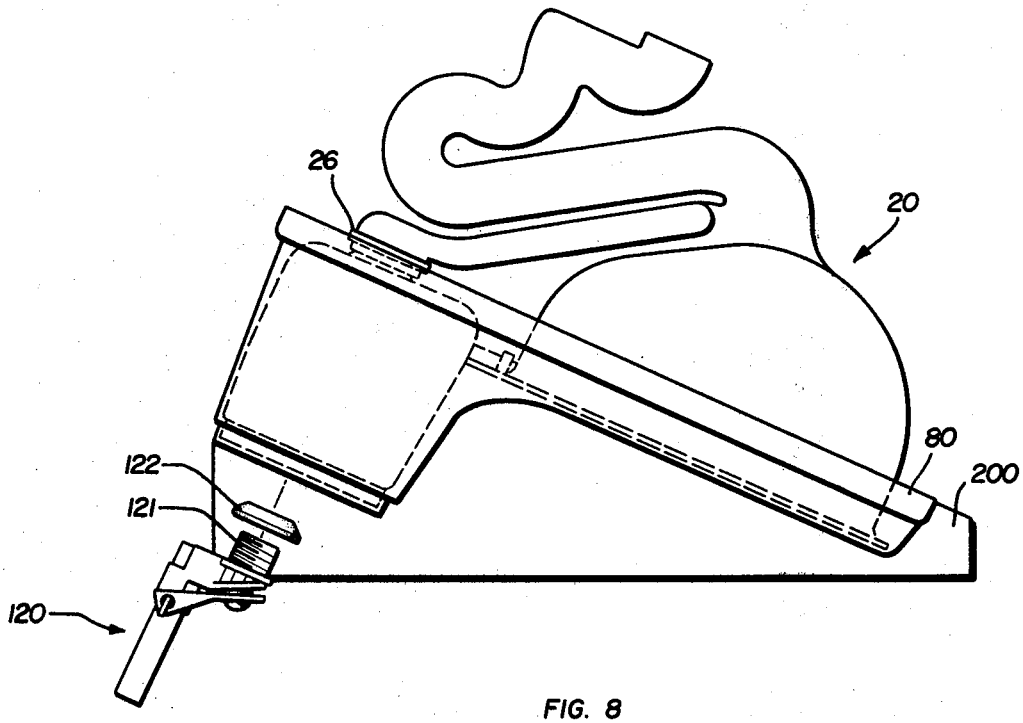
FIG. 8

PLASTIC TOILET

CROSS-REFERENCE TO RELATED APPLICATIONS

The subject matter of this application is related to the subject matter disclosed in applications Ser. Nos. 761,731, filed Jan. 24, 1977; now U.S. Design Pat. No. D247,913, 761,743, filed Jan. 24, 1977, and 801,506, filed May 31, 1977; now abandoned, all incorporated by reference.

BACKGROUND OF THE INVENTION

1. Field of the Invention

The present invention relates generally to a plastic toilet and to the method of manufacture. More specifically, various internal plastic components are surrounded by an exterior plastic shell, with cured foam filling the space between the exterior shell and the internal components for structural support.

2. The Prior Art

For the most part, toilets have conventionally been made from ceramic or vitreous china in order to meet applicable codes which require several features, including the absence of joints and cracks, particularly in the bowl and trap to prevent harbors for bacteria growth. Because the bowls have been made of china, all the other toilet portions have likewise been made of the same material to form either an integral product or a product comprised of components made of the same materials. In the method of making these prior types of toilets, many components are individually made and then assembled together. The assembled components are then covered with a common material to fill the joints and placed back into a kiln for a second phase of firing. As a result, substantial manual labor is required in assembling the various components and then coating the assembly. Additionally, substantial energy is required due to the multiple passes through the kiln. Such toilets are not easily handled because of their weight and are subject to breakage during shipping and installation.

Accordingly, a long-felt need has existed for a practical replacement for the prior art toilet in order to overcome these and other recognized disadvantages and shortcomings.

SUMMARY OF THE INVENTION

In one of its broader aspects, the invention relates to a plastic bowl, trap, and a plastic rim flush housed within an exterior shell. The plastic bowl is concave to provide a water-retaining region and includes an annular rim at the top of the bowl. The trap extends from a lower portion of the bowl to an outlet which is adapted for connection with a standard water closet flange. The rim is closely received within the top of the bowl and includes and interior duct for conveying water to the bowl periphery during flushing, with means being provided for supplying water to the rim flush. Cured foam fills the space in the interior of the outer shell between the shell and the bowl and rim flush for structural support.

In a more limited aspect of the invention, the bowl and trap are integral and are formed from a thermoplastic material. Preferably, a water passageway is also integral with the bowl and trap, the passageway communicating with the bowl by an inlet in the bottom of the bowl above the trap. The waterway then slopes upwardly from the region of the bowl to an inlet which is adapted for interconnection with a tank. The tank is preferably formed of a plastic material and integral with the plastic rim flush by virtue of a water passage and plastic flanges between the rim flush and tank. In this aspect of the invention, the bowl-trap-waterway and the tank-rim flush are each formed in a blow molding operation so that the respective integral parts are free of any joints.

To facilitate interconnection with the various components, the bowl may be provided with an outwardly flaring flange around its rim, over which an outwardly flaring flange on the rim flush seats. A separate connector member is preferably provided to interconnect the inlet of the waterway with the tank.

In another more limited aspect of the invention, the outer encasing shell is formed of a plastic material in two parts. A bottom outer shell surrounds the bowl, trap and waterway and includes a bottom flange closely surrounding the end of the trap, an upper peripheral sealing engagement surface, and sidewalls interconnecting the bottom flange and the sealing portion. A top outer plastic shell surrounds the top of the bowl, the rim flush, and the tank, and includes a lower peripheral sealing portion for cooperating with the sealing surface of the lower shell. An annular flange on the top shell extends downwardly into the bowl and closely surrounds the interior of the rim flush, with sidewalls extending around the tank. Most preferably, the sidewalls terminate in an inverted V-shaped peripheral flange which receives the upper portion of the tank for seating purposes.

Various types of hardware may be incorporated into the plastic toilet to regulate the flow of water from the tank to the bowl during flushing. For example, a flapper-type valve may be mounted within the tank to regulate the flow of water to the waterway and lower portion of the bowl for establishing a water vortex during flushing. Additionally, a conventional ball cock is mounted within the tank and includes a refill line for supplying water to the rim flush. In the disclosed embodiment, a push-button type flush lever is provided to regulate the ball cock and flapper valve action.

In the method of assembly, the plastic tank and rim flush is inserted within the top housing shell and temporarily secured in position. Then, the plastic bowl, trap and waterway are set into position so that the flange on the bowl registers with the flange on the rim flush. Once the bowl, trap and waterway are in proper position, a flapper-type valve is secured through the appropriate opening in the tank to a flush adapter at the inlet of the waterway, pulling the waterway up into the bottom of the tank and thereby securing the top shell, tank-rim flush, and bowl-trap-waterway together. An outer plastic shell is then positioned over the bowl-trap-waterway to register with the top shell. Next, foam is either sprayed or injected into the outer plastic shells to fill the cavity between the shells and the internal components to provide structural rigidity to the overall assembly. Finally, the other toilet hardware is secured in position.

Accordingly, the present invention relates to a plastic toilet providing numerous advantages over the prior art. Specifically, the present invention provides a product which (1) is made of plastic material, incorporating the disclosures of Ser. Nos. 761,731, 761,743, and 801,506; (2) is relatively inexpensive in comparison with the prior art products; (3) is light and is therefore easy to handle and inexpensive to ship; (4) achieves a reduced water consumption during toilet flushing; (5) is easy to clean; (6) is not easily damaged during shipping and installation; (7) is easily installed; and (8) conserves energy due to the manufacturing method employed.

These and other meritorious features and advantages will be more fully appreciated from the following description and the appended claims.

BRIEF DESCRIPTION OF THE DRAWINGS

FIGS. 4–10 illustrate the method of assembling the various components to form the final product.

DETAILED DESCRIPTION OF THE PREFERRED EMBODIMENT

Figure 1:
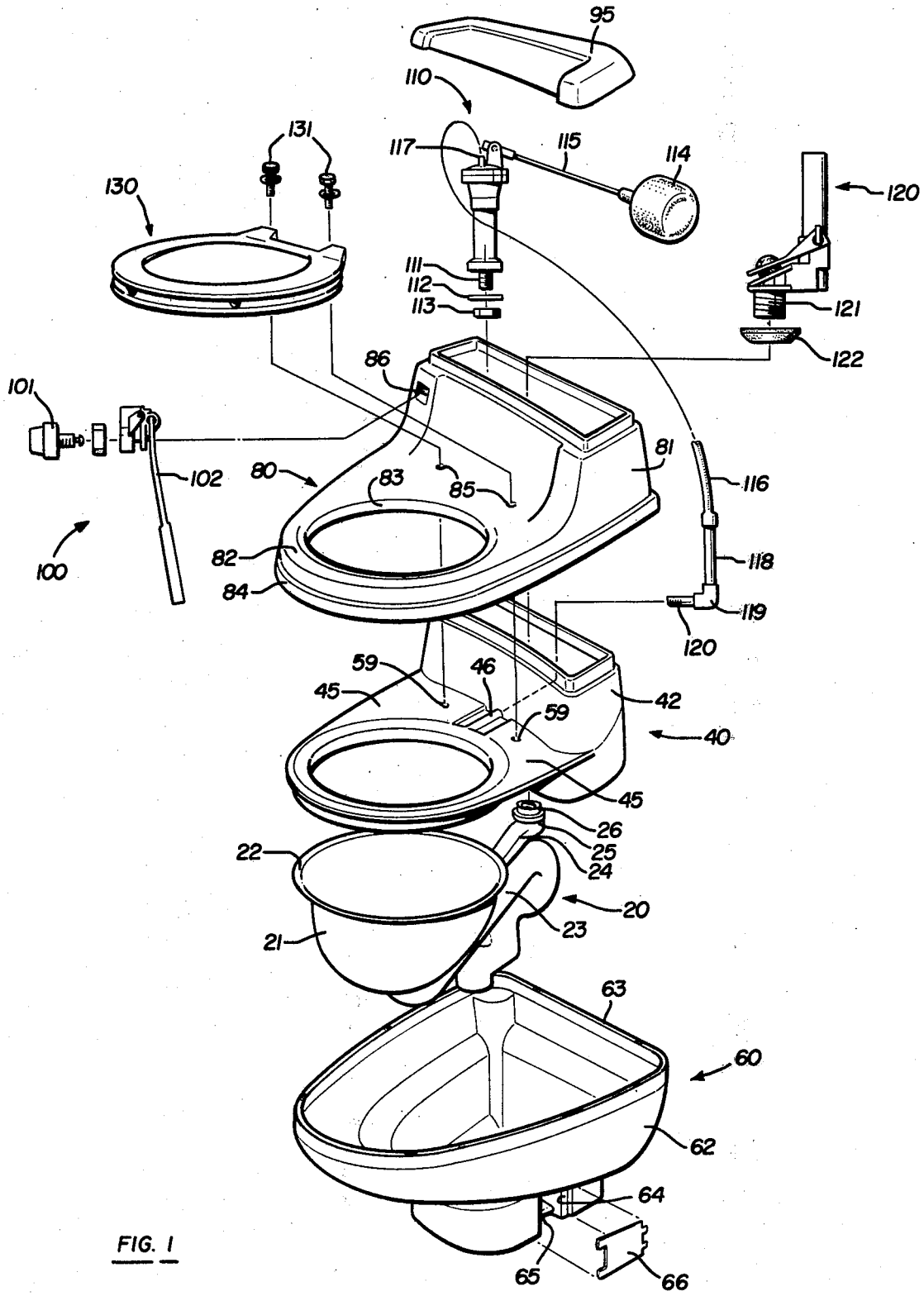
FIG. 1 is an exploded perspective view of the overall toilet assembly.

FIG. 1 illustrates, in an exploded perspective view, the various primary components of the present invention. These components include an integral, unitary bowl, trap and waterway 20, an integral, unitary tank and rim flush 40, exterior plastic shells 60 and 80, a tank top 95, a push-button flush lever assembly 100, a ball cock assembly 110, a flapper-type valving mechanism 120, and a toilet seat 130.

The integral bowl, waterway and trap are more fully disclosed and described in pending application Ser. No. 761,743, incorporated by reference. In brief, though, this assembly includes a concave bowl which is preferably circumscribed at its upper opening by an outwardly directed flange 22. At the other end of the bowl is an outlet (not shown) leading into a trap 23. This trap includes a first upwardly turned section 23A, an elbow 23B and tortuous section 23C leading into an essentially tubular outlet 23D which is adapted for interconnection with a standard water closet flange. As more fully discussed in Ser. No. 761,743, the elbow bend at 23B establishes a water line within the bowl 21 and the tortuous flow path 23C serves to impede the water flow to establish the desired flushing action.

The waterway 24 communicates with a lower portion of the bowl 21 at an outlet opening (not shown here but more fully disclosed in Ser. No. 761,743) for the purpose of establishing a water vortex during flushing. Most preferably, the waterway is on the symmetrical center line of the bowl, which includes a wall (again not shown here but more fully discussed in Ser. No. 761,743) overlapping at least a part of the waterway outlet to assist in directing the water flow around the inner periphery of the bowl to establish the desired vortex. From the outlet, the waterway 24 extends upwardly at an angle of about 30° with respect to the horizontal. This portion of the waterway preferably includes gradual curves (not shown here) which serve to impede the flow of water in order to more effectively assist in turning the water at the waterway outlet for establishing the water vortex in the bowl. The waterway terminates in an inlet 25 at its upper extremity which receives water from the toilet tank. A separate connector element 26 is preferably provided to interconnect the waterway inlet 25 to a valving arrangement 120 within the tank. The connector element 26 may include, at one end, an annular groove to receive an essentially tubular terminal upper end portion of the waterway inlet 25. The tubular end may be secured within the groove as desired, for example, by spin or other welding methods. At the other end, the connector 26 includes a threaded portion to receive a complementary threaded portion of the valving arrangement 120.

Optional, desirable reinforcing ribs 27,28, and 29 may be provided respectively between portions 23A and 23C of the trap, between section 23A of the trap and the waterway 24 and between the waterway 24 and the bowl 29 for reinforcement.

In the preferred embodiment, and as more fully disclosed in pending Ser. No. 761,743, the bowl, trap, and waterway are integral and formed of a thermoplastic material, preferably in a blow molding arrangement. Accordingly, this subassembly is free of joints which provide harbors for bacteria growth. Only fused seam lines may extend along the symmetrical reference plane which includes reinforcing webs 27,28, and 29, as a result of the blow molding operation.

As an alternative to the illustrated arrangement, the waterway 24 may flow directly into the trap 23 in the event that a siphon-jet action is desired. As another alternative, the waterway may be eliminated altogether, such that the total water flow is through the rim flush to provide a wash down type flushing action.

Figure 5:
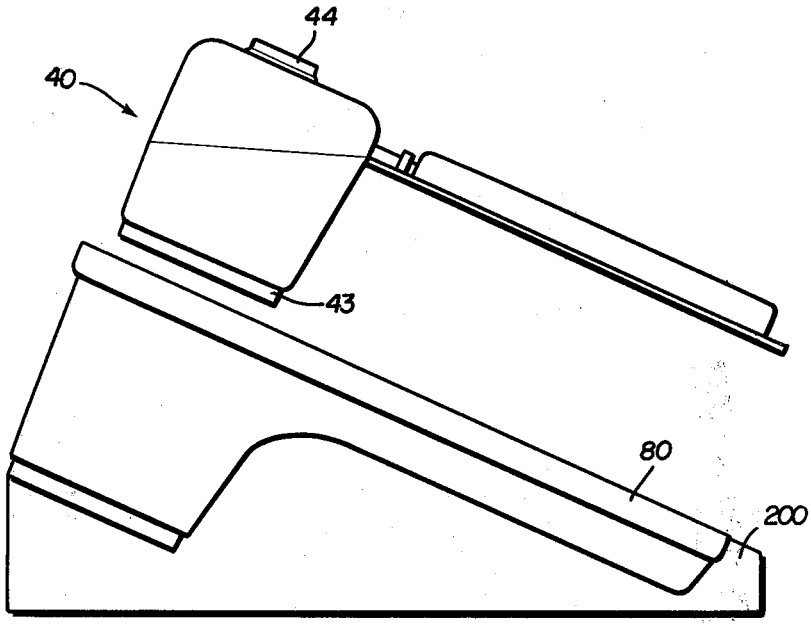
Figure 6:
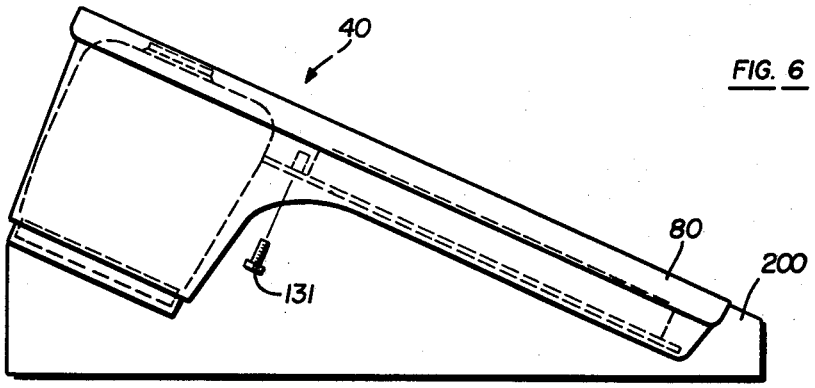

The tank and rim flush 40 are more fully disclosed and discussed in pending application Ser. No. 801,506, incorporated by reference. In short, though, the tank includes a bottom wall 41 and integral sidewalls terminating in an upwardly directed peripheral flange 43. This flange is particularly adapted to fit within a grooved flange in the upper shell housing 80, as more fully disclosed below. As shown best in FIG. 5, and as more fully disclosed in application Ser. No. 801,506, a primary downwardly depending flange 44 is centrally located in the bottom wall 41 of the tank for receiving the connector 26 and the inlet of the waterway 25. This flange provides a circular opening through which the threaded portion of valving arrangement 120 fits and accommodates the flow of water from the tank to the waterway 24 during toilet flushing.

The rim flush includes an inner peripheral sidewall 51 over which a lip or flange of the upper shell 80 fits, as more fully disclosed below. An outer peripheral sidewall 52 is generally parallel to sidewall 51 and preferably seats within the upper portion of the toilet bowl 21 adjacent the rim flange 22. An annular, oval-shaped bottom wall 53 slopes downwardly from the inner peripheral sidewall 51 and includes a plurality of spaced openings 54 which distribute water around the periphery of the toilet bowl to achieve a desired washing action during flushing. A sloping top wall 55 integrally interconnects the inner and outer peripheral sidewalls 51 and 52 and continues outwardly in a peripheral reinforcing flange 56 for overlying the rim flange 22 of the bowl. The flange 56 is approximately twice as thick as the sidewalls 51–55, as a result of the preferred method of forming the integral tank and rim flush, i.e. by a blow molding operation more fully disclosed in Ser. No. 801,506.

Integral inserts 59 (shown diagramatically in FIG. 1, but shown in greater detail in Ser. No. 801,506) may optionally be integrally encased in the plastic material of reinforcing ribs or webs 45 formed during the blow molding operation and integrally interconnecting the rim flush with the tank. Such inserts may be of conventional design, including a threaded tubular portion and a flange which is sandwiched within the plastic material. These inserts are provided to receive bolts for attaching the toilet seat to the overall assembly, as more fully discussed below.

Figure 3:
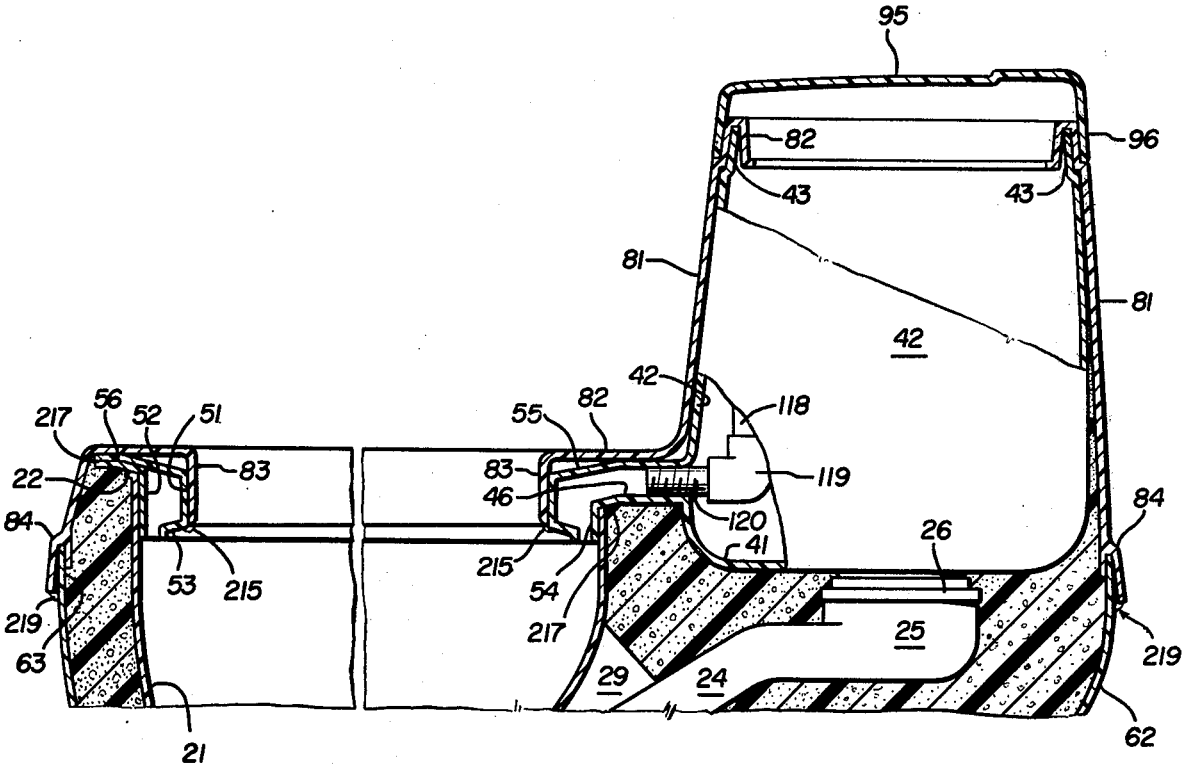
FIG. 3 is a fragmented cross-sectional view, illustrating the details of the interconnections and interfittings of the two outer shells and of the bowl and rim flush.

As best shown in FIG. 3, a water passageway 46 integrally interconnects the tank with the rim flush. This member is essentially tubular and may include a threaded interior surface to receive a fitting associated with the ball cock, as more fully disclosed below. In essence, the water passageway 46 provides a path for water flow from the tank to the rim flush during toilet flushing. As will become apparent, the water supplied to the water passageway 46 and rim flush is supplied by the ball cock 110 by way of suitable fill pipes.

Like the integral, unitary bowl, waterway and trap, the integral tank and rim flush are formed preferably by a blow molding procedure to achieve a product which is free of any joints, including only pinch lines forming fushed seams. Both the blow molded parts may be formed of a suitable thermoplastic material, preferably polypropylene.

As an alternative, the tank and rim flush may be formed as separate components, with a separate member providing a water flow passageway between the tank and rim. Of course, the disclosed unitary construction is desirable from the stand point of manufacturing two components simultaneously and from the standpoint of reducing the number of component parts. As another alternative, the tank might be eliminated altogether, such as in toilets for public facilities. In such an arrangement, water passageway means could provide flow directly to the rim flush and the water passageway associated with the bowl.

The exterior shells 60 and 80 are preferably formed in a vacuum-forming operation from a rigid polyvinylchloride material. Alternatively, the shells could be made by an injection molding operation from a suitable thermoplastic or thermosetting material. Most preferably, these shells will have the design of that shown in pending application Ser. No. 761,731, but of course may take other suitable configurations.

The lower shell 60 includes an essentially annular flange 61 which closely surrounds the outlet 23D of the trap. As is conventional, a standard wax seal may be used between the flange 61 and the standard closet flange when the toilet is installed for operation. Bottom and sidewalls 62 extend from the flange 61 and terminate in a peripheral engagement surface 63. Indents 64 (see FIG. 1) may be provided on each side of the bottom shell 60, with a bottom wall 65 of the indent being provided with a suitable opening for receiving a bolt to secure the toilet to a floor when installed. As shown in FIG. 1, a cover plate 66 may be provided to overlay each indent 64.

The upper shell includes upwardly extending sidewalls 81 to surround the tank 42, these sidewalls terminating in a peripheral inverted V-shaped flange 82 to receive the upwardly directed flange 43 of the tank. By this arrangement, the tank is properly centered and held into position with respect to the upper shell.

The sidewalls 81 blend into a region 82 corresponding essentially in shape to the outline of the rim flush. As shown best in FIG. 3, this region 82 includes a downwardly extending flange 83 which is closely received within the interior of the rim flush. Both the sidewalls 81 and region 82 extend downwardly and terminate in a peripheral channel-shaped locking member 84 which receives the upper sealing portion 63 of the bottom shell to provide a sealing arrangement. Appropriate openings 85 are provided in alignment with inserts 59 to receive bolts associated with the toilet seat 130.

A toilet lid 95 is provided with a downwardly directed peripheral flange 96 which is received on shell 80, as best shown in FIG. 3, to cover the toilet tank, as is conventional.

The primary hardware for the disclosed toilet includes the push-button lever assembly 100, the ball cock 110, and the flapper-type valve 120. All this hardware may be obtained commercially as conventional items from a variety of sources. The flush assembly 100 includes a push-button mechanism 101 protruding from an opening 86 in top shell 80. This push-button assembly appropriately interconnects with a lever arrangement 102 inside the tank which regulates the action of the flapper-type valve 120. This type of flapper valve is generally disclosed in U.S. Pat. No. 3,707,733, which is incorporated by reference to supplement this disclosure. In short, however, the flapper arrangement includes a threaded tubular section 121 which is received in the previously disclosed flange opening in the bottom of the tank for threaded interconnection with coupling element 26. A shank-type washer 122 is preferably provided for fitting within the flange opening for sealing purposes.

The ball cock arrangement 110 includes a threaded shank 111 which registers with a seal 112 and nut 113 for projection through a secondary flange opening in the bottom of the tank (as more fully disclosed in pending application Ser. No. 801,506), the shank 111 being interconnected with an appropriate water source for filling the tank and supplying water to the rim flush. As shown, a float 114 and a float rod 115 regulate the ball cock 110 in a conventional manner. Additionally, a tubular plastic fill line 116 extends from a water flow line 117 on the ball cock for insertion over a tubular pipe 118, which is interconnected with an elbow 119 and a second tubular pipe 120. As illustrated best in FIG. 3, the threaded pipe 120 is received within the water passageway 46 for the purpose of supplying water to the rim flush during toilet flushing.

The seat 130 may be of any conventional design and is preferably secured to the toilet assembly by a pair of bolts 131 which extend through openings 85 in the top shell 80 for fitting within threaded inserts 59.

In operation, flushing action is initiated by depression of the push-button lever arrangement 101. This actuates lever arm 102 to open the flapper valve, accommodating flow of water from the tank through waterway 24 into the lower portion of the bowl to establish an immediate vortex action. As the water level in the tank drops, float 114 activates the ball cock 110 to supply water to the tank and to the rim flush by way of tube 116, pipes 118, 119, and 120, and water passageway 46. The water from the rim flush cascades dwon the interior surface of the bowl 21 to wash the bowl. Of course, water and waste in the bowl flow out through trap 23 and into the appropriate disposal system. By the overall arrangement of this invention, less water is consumed by reducing the total water consumption to about 2 ½ to 3 gallons. Additionally, the bowl is easily cleaned and there are no cracks or joints in the bowl or trap to facilitate bacteria growth.

Figure 4:
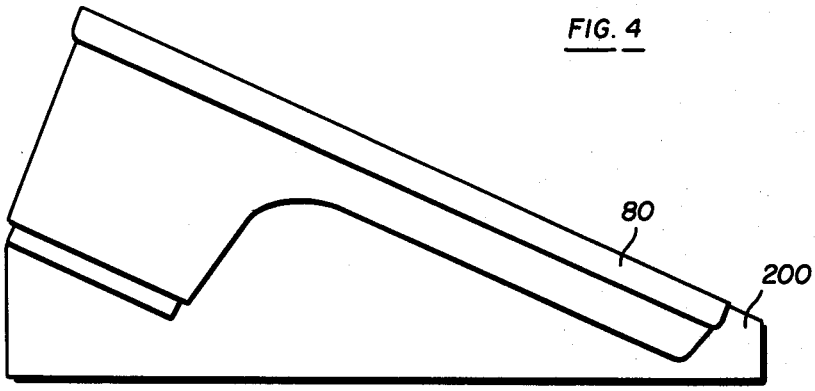

Turning now more particularly to FIGS. 4–10, the assembly procedure is initiated by positioning the top shell 80 in a complementary shaped fixture 200 in an essentially upside down position, as illustrated in FIG. 4. Next, the integral tank and rim flush 40 are inserted so that the upwardly directed flange 43 of the tank fits within the inverted V-shaped flange 82 of the shell and so that the rim flush seats around flange 83 (See Fig. 3). Then, the shell and integral tank and rim flush, as interfitted, may be turned upright to thread bolts 131 into the insert 59 to hold these components together temporarily. These attached components may then be replaced on the fixture 200, whereupon a suitable caulking material is applied to the bottom of flange 83 and the interior wall of the rim flush by a caulking gun 210, as illustrated in FIG. 7. This bead of caulking material is illustrated in FIG. 3 by reference numeral 215. Alternatively, a molded lock-type seal may be positioned between the two parts.

Next in sequence, the integral bowl, trap, and waterway 20 is set into position, with the connector element 26 already having been secured to the inlet 25 of the waterway. Referring back to FIG. 3, the bowl is inserted into the assembly so that the upper bowl rim portion receives the external wall 52 of the rim flush, with the flange 22 of the bowl seating against the outwardly directed flange 56 of the rim flush. Prior to inserting the bowl into this position, it may be necessary to trim the bowl in the region of the water passageway 46 to accommodate the desired fit. After the unitary bowl, trap and waterway 20 are properly positioned, the valving arrangement 120 is threaded into position by inserting the shank seal 122 into the tank flange opening and then threading shank 121 into the connector element 26. Since the top shell 80 and the unitary tank and rim flush are held in position by bolts 131, the interconnection between the valve 120 and the coupling element 26 secures the bowl, trap, and waterway to both the tank and the outer shell 80.

A bead of caulking material is then applied around the outer peripheral edge of the bowl flange 22 to seal that edge against the bottom surface of flange 56 of the rim flush. This bead of material is shown by reference numeral 217 in FIG. 3. Alternatively, a molded lock-type seal may be positioned between the two parts. A further alternative method is gas welding, using a filler rod of the same material.

Figure 9:
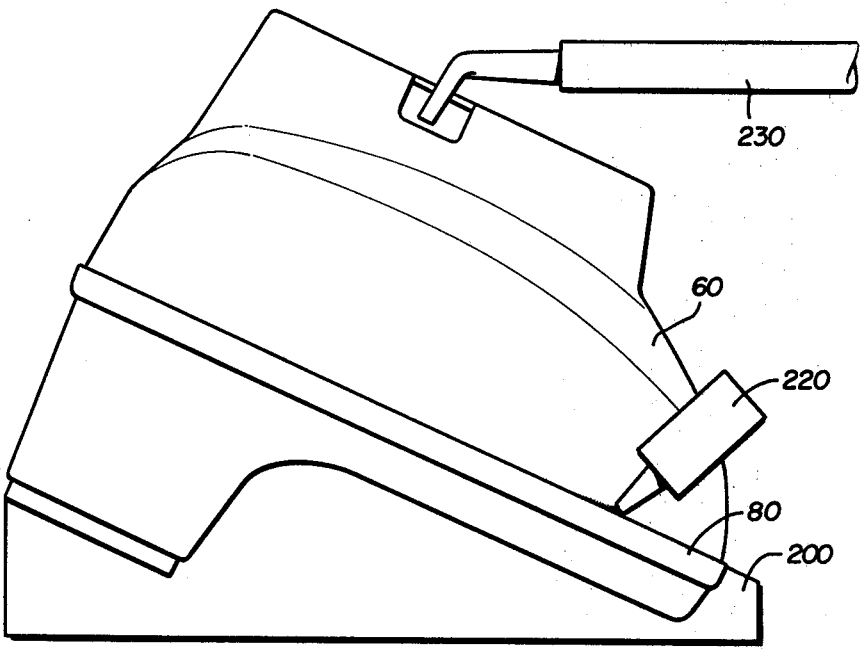
Figure 10:
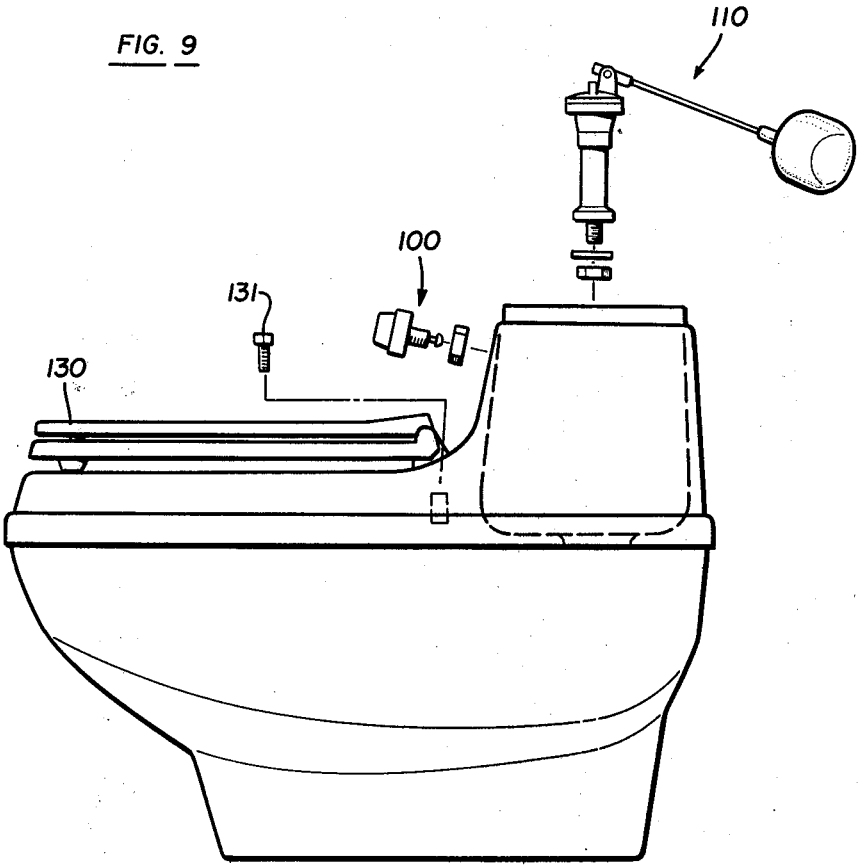

As illustrated in FIG. 9, the bottom shell 60 is then placed in position, with the upper peripheral sealing portion 63 fitting within the sealing channel 84 of the top shell 80. A suitable sealing solvent, such as tetrahydrafurane, is then applied around the bottom edge of flange 84 by an applicator 220 to seal the lower and upper shells 60 and 80 together. This bead of sealing material is illustrated in FIG. 3 by reference numeral 219. An alternative method to eliminate the solvent joint involves fixturing and foaming the unit immediately.

Figure 2:
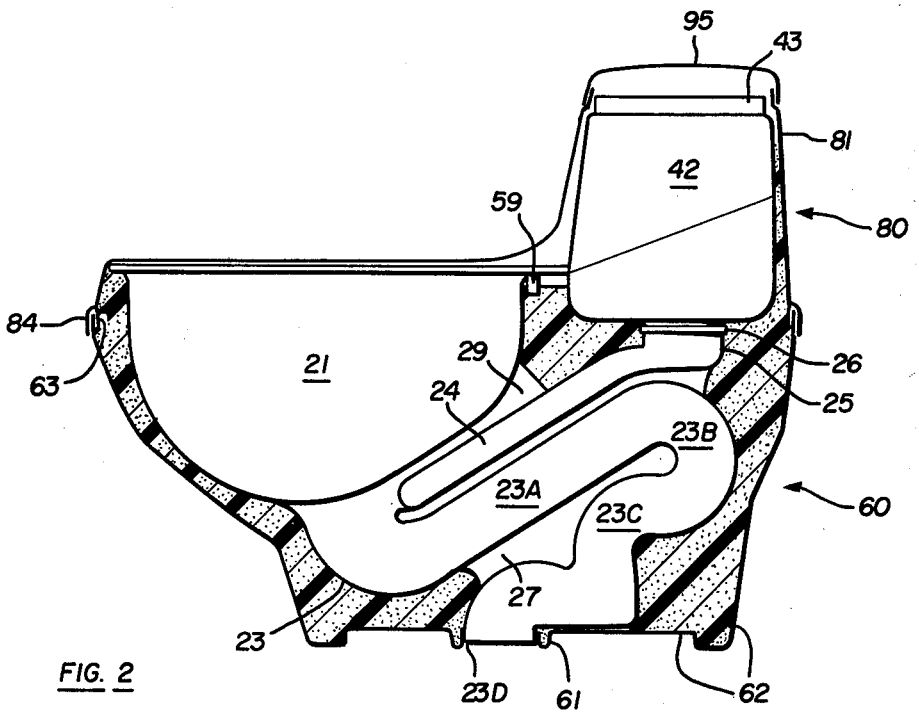
FIG. 2 is a partial cross-sectional view, illustrating the integral bowl, trap, waterway and the integral tank and rim flush in position within the outer shell housings, as filled with polyurethane foam.

While the assembled toilet is still retained on the fixture 200, a foam applicator 230 then either injects or sprays uncured foam, preferably polyurethane, through appropriate openings in the bottom of shell 60 to fill the space between the shells and the internal components to achieve a rigid structure, as shown in FIG. 2, to withstand weight applied to the toilet during use, and serves as a joining element.

After the foam has sufficiently expanded and cured in place, the toilet assembly is then returned to its upright position to secure the seat, push-button flush lever, and ball cock into position. Of course, bolts 131 must be removed and then threaded back into the inserts after the seat 130 is placed in position.

As will be appreciated, various modifications and alternations may be made to the disclosed embodiment without departing from the overall invention, since the invention is limited only the following claims.

Having therefore completely and sufficiently disclosed our invention, we now claim:

1. A plastic toilet, comprising:

an integral, single piece plastic bowl and trap unit, said plastic bowl and trap unit being free of any joints and having an essentially smooth interior surface, the bowl being concave and circumscribed at its top by a rim, and the trap extending from a bottom portion of the bowl and terminating in an essentially tubular end portion for connection to a water closet flange;

an integral, unitary plastic tank and rim flush unit, the tank being concave to form a water-holding compartment and being circumscribed at its top by a peripheral edge, the rim flush communicating with the tank by a water passage integral with both the tank and rim flush, and the rim flush including an annular tubular conduit for conveying water by gravity through openings along the length of the conduit to the upper interior periphery of the bowl, the conduit being sized to fit closely within the bowl top adjacent the rim;

a bottom outer plastic shell, said plastic bowl and trap unit inserted into said bottom outer plastic shell and said plastic shell surrounding the bowl and trap unit and including (a) a bottom flange closely surrounding the tubular end portion of the trap (b) an upper peripheral portion and (c) side walls integrally interconnecting the bottom flange and the upper peripheral portion;

a top outer plastic shell, said top outer plastic shell placed onto said plastic tank and rim flush unit to surround the top of the bowl, the rim flush, and the tank, the top shell including (a) a lower peripheral portion for cooperatively defining a continuous peripheral seal with the upper peripheral portion of said bottom shell and (b) side walls surrounding the tank; and reinforcing foam in the interior of the shells and between the bowl, trap, tank and the outer shells for reinforcement.

2. The toilet as defined in claim 1, wherein the top of the bowl includes an outwardly flaring flange, over which an outwardly directed flange on the rim flush seats.

3. The toilet as defined in claim 1, wherein a plastic waterway is integral with the bowl and trap, the waterway including an exit opening in a lower portion of the bowl and an elongated duct sloping upwardly from the exit opening and terminating in an upper inlet opening; the tank including a first generally tubular integral flange extending downwardly from a bottom wall thereof; and means for securing and sealing the waterway inlet opening to the first tank flange to accommodate the flow of water from the tank to the lower portion of the bowl during a flushing cycle to establish a water vortex.

4. The toilet as defined in claim 1, wherein the top shell further includes an annular flange extending downwardly into the bowl and closely surrounding the interior of the annular rim flush conduit.

5. The toilet as defined in claim 1, wherein the top shell further includes an inverted U-shaped peripheral flange on the top of side walls thereof for receiving the peripheral edge of the tank, and wherein the toilet further includes a plastic tank top for removably seating on the inverted flange on the top shell.

6. A plastic toilet, comprising:

an integral, single piece bowl and trap unit, said bowl and trap unit being free of any joints and having an essentially smooth interior surface, the bowl being concave and circumscribed at its top by an annular rim and the trap extending from a lower portion of the bowl to an essentially tubular end portion for connection to a water closet flange;

an integral, unitary plastic tank and rim flush unit, the tank being concave to form a water holding compartment, the rim flush communicating with the tank by a water passage, integral with both the tank and rim flush, and the rim flush including an annular tubular conduit for conveying water by gravity through openings along the length of the conduit to the upper interior periphery of the bowl, the conduit being sized to fit closely within the bowl top adjacent the rim;

an outer plastic shell comprising a bottom outer portion and a top outer portion, said bowl and trap unit inserted into said bottom outer portion and said bottom outer portion surrounding said bowl and trap unit, said top outer portion surrounding said plastic tank and rim flush unit; and cured foam between the bowl and trap unit, the plastic tank and rim flush unit, and the outer plastic shell for reinforcement.

7. A plastic toilet, comprising:

an integral, single piece plastic bowl, trap and waterway unit, said plastic bowl, trap and waterway unit being free of any joints and having an essentially smooth interior surface, the bowl being concave and being circumscribed at its top by an annular edge, the trap including a first end communicating with the bowl, an essentially tubular second end portion for connection to a water closet flange, and a tubular section interconnecting the two ends, and the waterway including an upper inlet for receiving water, an elongated duct sloping downwardly from the inlet and terminating in an exit opening in the lower interior of the bowl at a position above the trap inlet to establish a vortex within the bowl during flushing;

an integral, unitary plastic tank and rim flush unit, the tank being concave to form a water-holding compartment and including an outlet in the bottom thereof, the rim flush communicating with the tank by a water passage integral within both the tank and rim flush, and the rim flush including an annular hollow ring for conveying water to the interior periphery of the bowl;

connection means for attaching the upper waterway inlet to the tank outlet;

a bottom outer plastic shell, said plastic bowl, trap and waterway unit inserted into said bottom outer plastic shell and said plastic shell surrounding the bowl, trap and waterway and including (a) a bottom flange closely surrounding the tubular second end portion of the trap (b) an upper peripheral portion; and (c) sidewalls interconnecting the bottom flange and upper peripheral portion;

a top outer plastic shell, said top outer shell placed onto said plastic tank and rim flush unit to surround the top of the bowl, the rim flush, and the tank, the top shell including (a) a lower peripheral sealing portion for cooperatively defining a continuous peripheral engagement seal with the upper peripheral portion on the bottom shell, (b) an annular flange extending downwardly into the bowl and closely surrounding the interior of the rim flush, and (c) side walls surrounding the tank; and reinforcing foam between the bowl, trap, tank and the outer shells.

* * * * *